US007055720B1

(12) United States Patent
Pritchard

(10) Patent No.: US 7,055,720 B1
(45) Date of Patent: Jun. 6, 2006

(54) FLEXIBLE PACKAGE HAVING A FITMENT POUR SPOUT AND A RECLOSABLE MOUTH USING A ZIPPER TYPE CLOSURE

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 62 days.

(21) Appl. No.: 10/993,086

(22) Filed: Nov. 19, 2004

(51) Int. Cl.
*B65D 35/08* (2006.01)

(52) U.S. Cl. ..... 222/107; 222/92; 222/143; 222/541.6; 222/566; 383/10; 383/32; 383/61.2; 383/63; 383/66; 383/104; 383/906; 383/80

(58) Field of Classification Search ..... 222/105, 222/107, 92, 143, 482, 566, 541.6, 567–568, 222/562; 383/209, 10, 61, 63, 61.2, 204, 383/41, 104, 906, 32, 66, 80
See application file for complete search history.

(56) References Cited

U.S. PATENT DOCUMENTS

| | | | | |
|---|---|---|---|---|
| 5,059,036 | A | 10/1991 | Richison et al. | |
| 5,147,272 | A | 9/1992 | Richison et al. | |
| 5,709,479 | A | 1/1998 | Bell | |
| 5,882,120 | A | 3/1999 | Bell | |
| 5,954,433 | A * | 9/1999 | Yeager | 383/203 |
| 5,971,613 | A | 10/1999 | Bell | |
| 6,126,318 | A | 10/2000 | Bell | |
| 6,224,528 | B1 | 5/2001 | Bell | |
| 6,375,037 | B1 | 4/2002 | Bell et al. | |
| 6,578,740 | B1 * | 6/2003 | Hagihara | 222/107 |
| 6,857,779 | B1 * | 2/2005 | Olin | 383/204 |
| 6,981,614 | B1 * | 1/2006 | Niggemyer | 222/107 |
| 2003/0059130 | A1 * | 3/2003 | Yoneyama et al. | 383/10 |
| 2004/0120613 | A1 * | 6/2004 | Hanson | 383/120 |
| 2005/0041894 | A1 * | 2/2005 | Hanson | 383/120 |
| 2005/0238264 | A1 * | 10/2005 | Ikeda et al. | 383/120 |

* cited by examiner

*Primary Examiner*—Frederick C. Nicolas
(74) *Attorney, Agent, or Firm*—Caesar, Rivise, Bernstein, Cohen & Pokotilow, Ltd.

(57) ABSTRACT

A flexible stand-up package having a releasably securable closure, a fitment pour spout and a handle. The package includes a hollow interior of the package arranged to be filled with a flowable material, e.g., cherries in syrup, whereupon the bottom of the package assumes a generally planar configuration to support the package, while portions of the panels making up the package assume a vertical orientation, with the pour spout located in a recessed position, whereupon the filled package can be located immediately adjacent similar filled packages without wasted space therebetween.

15 Claims, 4 Drawing Sheets

102
60
32

64
22
102
58
68
66
20
56
26
70
24
28
36
52
48
42
46
10
40
12
30B
30
30
34
30A
40

FIG.3
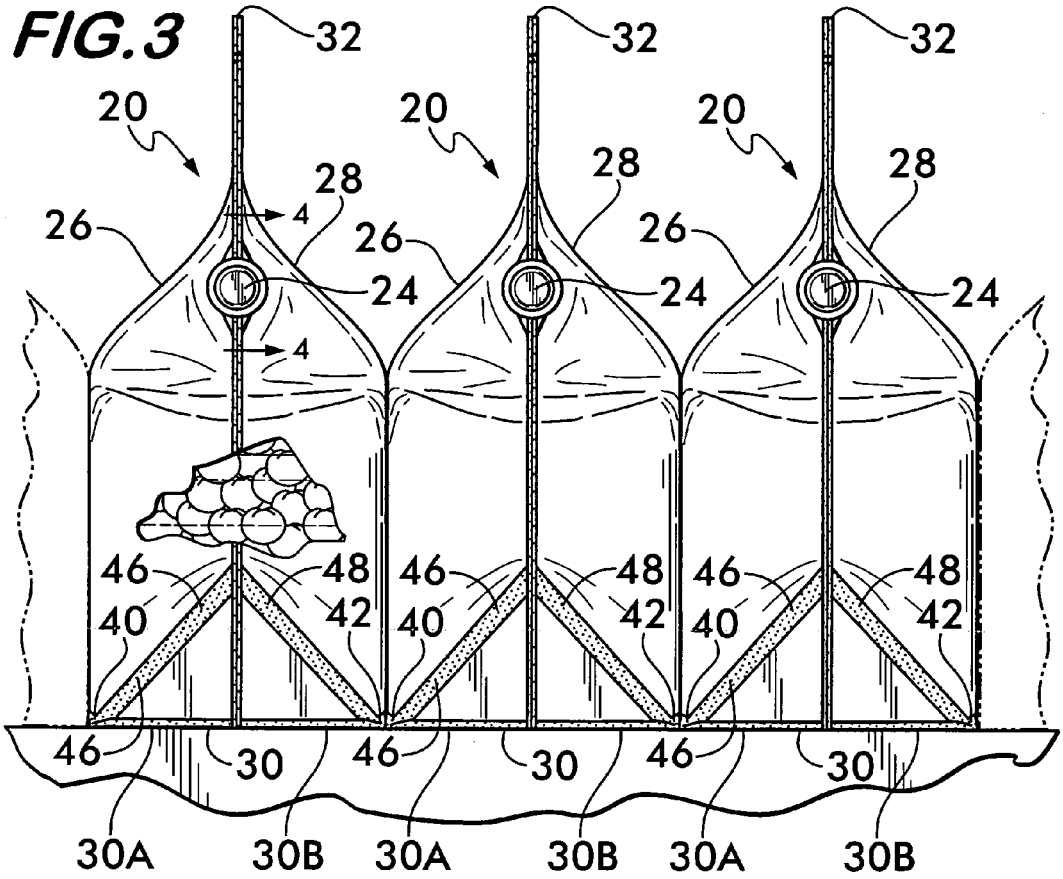
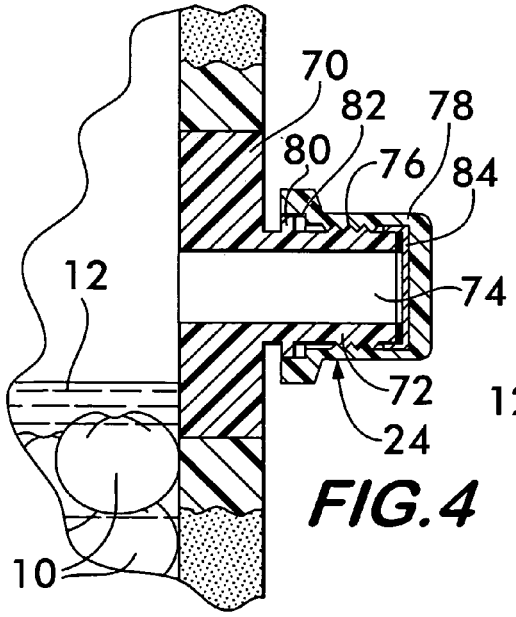
FIG.4
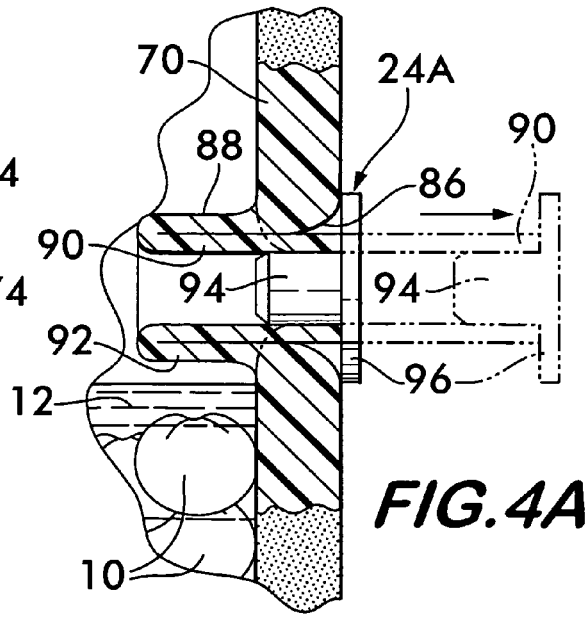
FIG.4A

FLEXIBLE PACKAGE HAVING A FITMENT POUR SPOUT AND A RECLOSABLE MOUTH USING A ZIPPER TYPE CLOSURE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISK

Not Applicable.

BACKGROUND OF THE INVENTION

1. Field of Invention

This invention relates generally to flexible packages, and more particularly to flexible packages for holding products, which when filled can be disposed closely adjacent one another without significant wasted space therebetween.

2. Description of Related Art

Stand-up pouches, are commercially available and typically include so-called "zipper-type" closures. Examples, of such packages are shown in U.S. Pat. No. 5,059,036 (Richison et al.), U.S. Pat. No. 5,147,272 (Richison et al.), and U.S. Pat. No. 5,147,272 (Richison et al.). Stand-up packages including pour spout fitments are also known in the prior art. See for example, U.S. Pat. No. 5,971,613 (Bell) and U.S. Pat. No. 6,224,528 (Bell).

Other prior art patents disclose flexible stand up packages for flowable materials and which include handles for lifting or transporting those packages. See for example, U.S. Pat. No. 5,709,479 (Bell), U.S. Pat. No. 5,882,120 (Bell), U.S. Pat. No. 6,126,318 (Bell) and U.S. Pat. No. 6,375,037 (Bell).

It has also been suggested to provide a stand-up pouch including a zipper type closure and a fitment pour spout for holding materials that include solid or semi-solid bodies and a liquid, e.g., maraschino cherries in juice, to enable the solid/semi-solid bodies to be removed from the package via the zipper closure and to enable the liquid to be poured from the package via the fitment.

While the foregoing prior art packages may be generally suitable for their intended purposes, they nevertheless leave much to be desired from the standpoint of providing a compact structure when filled to enable similar filled packages to be disposed immediately adjacent one another without significant wasted space therebetween.

SUMMARY OF THE INVENTION

A package having a releasably securable closure and a fitment pour spout. The package is formed of a flexible material and comprises a first side panel, a second side panel, and a bottom gusset panel connected to one another to form a hollow interior. The first and second side panels each have an inner surface, a front edge, a rear edge, a top edge, a bottom edge and a longitudinal axis. The top and bottom edges extend generally parallel to each other and transversely to the longitudinal axis.

The bottom gusset panel is connected to the bottom edge of the first side panel and to the bottom edge of the second side panel. The front edge of the first and second side panels is connected together along a front seal line. The rear edge of the first and second side panels are connected together along a rear seal line. The rear edge includes a portion extending at an acute angle to the longitudinal axis.

The front edge includes a fitment receiving portion extending at an acute angle to the longitudinal axis. The fitment pour spout is fixedly secured to the fitment receiving portion of the front edge and is in communication with the hollow interior of the package.

The top edge of the first and second panels is of a shorter length than the bottom edge of the first and second panels and portions of those panels contiguous with the top edge are disposed confronting each other to form an openable mouth for the package. The releasably securable closure comprises a pair of engageable components arranged to engage each other to close the mouth of the package. One of the engageable components extends along the inner surface of the first side panel adjacent the top edge of said first side panel. The other of the engageable components extends along the inner surface of the second side panel adjacent the top edge thereof.

The hollow interior of the package is arranged to be filled with a flowable material, e.g., cherries in juice, whereupon the bottom gusset panel assumes a generally planar configuration to form a horizontally disposed base for supporting the package on a surface while the rear edge of the first and second side panels extends generally perpendicularly to the base, whereupon the filled package can be located immediately adjacent similar filled packages without wasted space therebetween.

DETAILED DESCRIPTION OF THE INVENTION

DESCRIPTION OF THE DRAWING

FIG. 3 is a reduced front elevation view of the plural filled packages shown in FIG. 2;

FIG. 4 is an enlarged sectional view taken along line 4—4 of FIG. 3 and showing one exemplary type of a pour spout/fitment of the subject invention;

FIG. 4A is an enlarged sectional view also taken along line 4—4 of FIG. 3, but showing another exemplary type of a pour spout/fitment of the subject invention;

DETAILED DESCRIPTION OF THE PREFERRED EMBODIMENT

Figure 1:
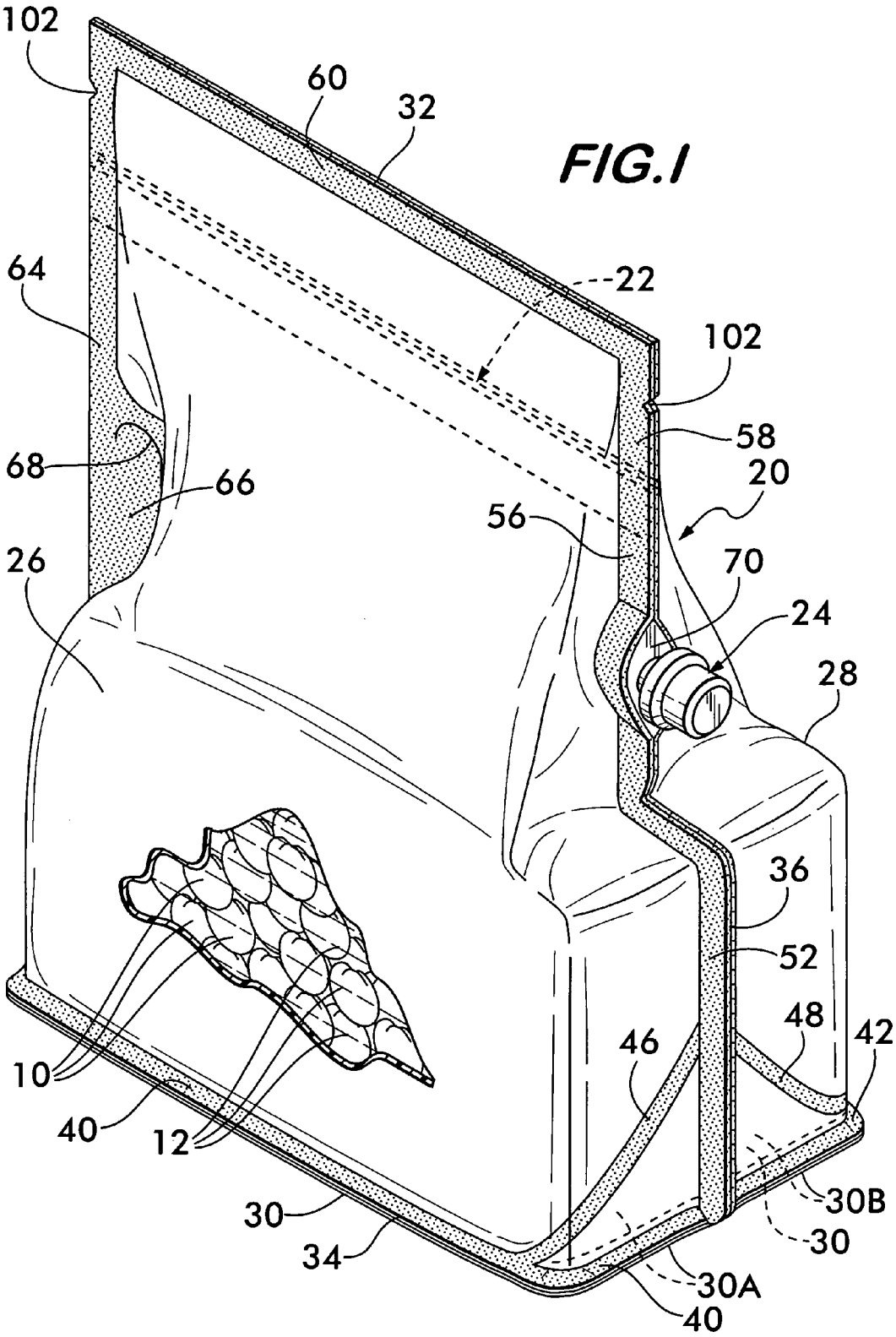
FIG. 1 is an isometric view of one exemplary embodiment of a flexible package constructed in accordance with this invention, with the package shown in its filled and sealed condition.

Referring now in greater detail to the figures, there is shown at 20 in FIG. 1 a package constructed in accordance with the teachings of this invention. The package is formed of a flexible material and is designed to hold flowable products, particularly, products including solid or semi-solid bodies within a liquid, e.g., maraschino cherries 10 in juice 12 or syrup. The package includes a zipper-type closure 22 (to be described later) to enable solid/semi-solid contents, e.g, cherries 10, within the package to be readily removed therefrom and a pour spout fitment 24 (also to be described later) to enable the liquid contents, e.g, juice 12, within the package to be readily poured out of the package.

Before describing the details of the package 20, it should be noted that the package 20 shown and described hereinafter is merely one of many possible configurations for packages constructed in accordance with this invention. Thus, the size or product type(s) held within the package is/are merely exemplary and not limiting. Moreover, the package 20 can be made of a variety of flexible materials, such as a variety of paper, plastic and/or foil materials, in single or multiple layers, as required by the product to be packaged, and provided that such materials are liquid proof and can be thermally bonded, e.g., welded, in the manner well known to the flexible packaging industry.

Figure 5:
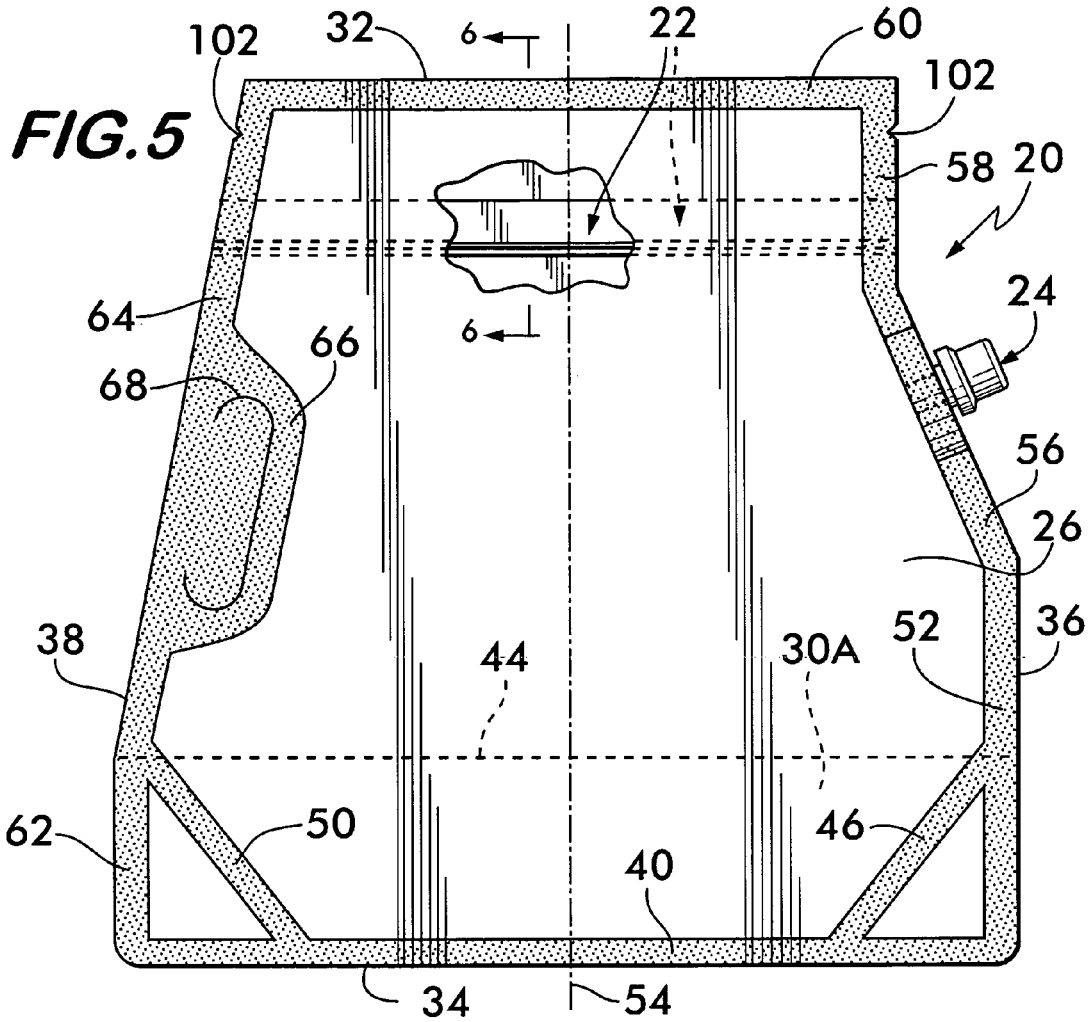
FIG. 5 is a side elevation view of the exemplary package of FIG. 1 but shown in its unfilled condition.

In the preferred embodiment shown the bottom of the package 20 is constructed somewhat like a conventional stand-up pouch (e.g., U.S. Pat. No. 6,375,037, whose disclosure is incorporated by reference herein). The remainder of the package exhibits some significant differences (to be described later). To that end the package is formed of a sheet of flexible material. Thus, as best seen in FIGS. 1 and 5, the package 20 includes a first side panel 26, a second side panel 28, and a bottom gusset panel 30 (FIGS. 1 and 3). The first and second side panels are each of the same shape. Either or both of the panels 26 and 28 may include indicia, e.g., printed matter, thereon, if desired.

Each of the side panels 26 and 28 has a generally linear top edge 32, a generally linear bottom edge 34 (FIGS. 1 and 6), a front edge 36 and a rear edge 38. The bottom gusset panel 30 is secured to the side panels 26 and 28 in a conventional manner well known in the flexible packaging art. In particular, the bottom gusset panel 30 is secured, e.g., welded, along the bottom edge 34 of the first side panel 26 by a linear seal line 40 and along the bottom edge 34 of the second side panel 28 by a linear seal line 42. The gusset panel 30 includes two sections 30A and 30B (FIGS. 1 and 3). As best seen in FIG. 5, the two sections 30A and 30B of the gusset panel 30 are connected together at a top fold line 44. In a preferred exemplary embodiment of this invention the gusset panel 30 is an integral member, e.g., a single sheet of flexible material. As best seen in FIGS. 1 and 5, the lower portion of the first side panel 26 is secured to the underlying section 30A of the gusset panel 30 by an angled heat seal line 46 extending from the front edge 36 to the heat seal line 40. The lower portion of the second side panel 28 is secured to the underlying section 30B of the gusset panel 30 by an angled heat seal line 48 (FIG. 1) extending from the front edge 36 to the heat seal line 42. In a similar manner, the lower portion first side panel 26 is also secured to the underlying section 30A of the gusset panel 30 by an angled heat seal line 50 extending from the rear edge 38 to the heat seal line 40 and the lower portion of the second side panel 28 is secured to the underlying section 30B of the gusset panel 30 by an angled heat seal line (not shown) extending from the rear edge 30 to the heat seal line 42.

Turning now to FIG. 5, it can be seen that the front edge 36 of the first and second side panels 26 and 28, respectively, comprises a heat seal, e.g., weld, line 52 extending perpendicularly to the bottom edge of the first and second side panels and parallel to the longitudinal axis 54 of the package. The front edge 36 also includes a contiguous angled heat seal, e.g., weld, line 56 and a contiguous heat seal, e.g., weld, line 58 extending parallel to heat seal line 52 but located inwardly thereof and terminating at the top edge 32. The top edge is in the form of a linearly transversely extending heat seal line 60. The rear edge 38 of the first and second side panels 26 and 28, respectively, comprises a heat seal, e.g., weld, line 62 extending perpendicularly to the bottom edge 34 of the first and second side panels 26 and 28, respectively, and a contiguous angled heat seal, e.g., weld, line 64 terminating at the top edge heat seal line 32.

A portion of the first side panel 26 and second side panel 28 contiguous with the angled seal line 64 is heat sealed, e.g., welded, together in at an area or patch 66. This area or patch serves as the location of a handle for the package 20. To that end, an opening 68 is die cut in the area 66. In the embodiment shown the opening is in the form of a generally flattened C-shaped slit 66 whose longitudinal axis is generally parallel to the angled seal line 64. Thus, a person can insert fingers of his/her hand through the slit to lift and carry the package when it is filled, as will be described later. Alternatively the opening 68 can consist of a hole of any shape, e.g., a flat oval.

As best seen in FIG. 5, the pour spout/fitment 24 is secured, e.g., welded in place, between the first and second side panels at the angled heat seal line 56. Thus, the pour spout/fitment is recessed or located inward from the lower front edge seal line 52. This keeps the spout/fitment out of the way to enable plural filled packages to be stacked right up against one another without wasted space therebetween as will be described later.

As will be appreciated by those skilled in the art, the various heat seals forming the package 20 can be accomplished at one time in one step or in plural steps.

Any type of pour spout/fitment can be used with the packages 20 of the subject invention. For example, the two different embodiments of the pour spout/fitment 24 shown herein are of conventional construction and each basically comprises a canoe-shaped base 70 (FIGS. 1 and 4) having a central passageway to be described later extending therethrough. In the embodiment of FIG. 4, the spout/fitment is of the screw-on cap type and is designated by the reference number 24, while the embodiment of FIG. 4A is of the pull-out type and designated by the reference number 24A.

Turning to the embodiment of FIG. 4, it can be seen that the spout/fitment 24 includes a tubular section 72 that extends perpendicularly to the canoe-shaped base 70. The free end of the tubular section 72 is open to form the outlet port 74 for the spout/fitment. Helical threads 76 extend about the outer surface of the free end of the tubular section 72 to receive corresponding interior threads of a cap 78. The cap 78 serves as the means to seal the outlet port 74. An annular ring 80 extends about the periphery of the tubular section to engage a ledge portion 82 in the underside of the cap 78 to act as a stop precluding over-tightening of the cap. A linear member 84 is located on the undersurface of the cap to engage the free end of the tubular section 72 to seal the interface when the cap is in place, thereby preventing the accidental egress of liquid from the spout/fitment 24.

When all or only a portion of the liquid 12 contents of the package are desired to be dispensed from the package, all that is required is to remove the cap 78 and to lift and tilt the package 20 by its handle 68, whereupon the liquid in the interior of the package can flow out through the now open spout/fitment 24.

The pull-out cap type spout/fitment 24A of FIG. 4A will now be discussed. As can be seen, in such an embodiment, the canoe shaped base 70 includes a central passageway 86 and an invertable (extendable/retractable) tubular member 88 that includes an inner section 90 and an outer section 92. The inner section 90 extends from the inner surface of the canoe shaped base contiguous with the passageway 86 partially inwardly into the package's interior perpendicularly to the canoe-shaped base 70. The outer section 92 is contiguous with the inner section 90. The inner section 90 folds under the outer section to extend through the central passageway 86 toward the outer surface of the canoe shaped base 70. The free end of the outer tubular section 90 forms the outlet port of the spout/fitment 24A. A plug 94 having a flanged cap 96 seals the free end of the inner tubular section 90. The flange 96 of the cap 94 serves as a handle or grip which the user can grasp between his or her fingers to pull the inner tubular member 90 from its fully retracted position shown by the solid lines in FIG. 4A to its extended position, shown by the phantom lines therein. When pulled totally outward, the outer section 92 inverts and also passes through the passageway 86 so that a portion of it and the entire inner tubular member extend beyond the canoe shaped base. The inner tubular member 90 includes an opening (not shown) in its sidewall closely adjacent the cap 94. The opening serves as the outlet port of the fitment/spout of FIG. 4A. Thus, when the cap 94 is pulled to extend the tubular member to the extended position like shown in FIG. 4A, the opening in the sidewall of the tubular member is located outside the package and beyond the canoe shaped base, whereupon liquid from the interior of the package can flow therethrough.

When all or only a portion of the liquid contents of the package is desired to be dispensed from the package, all that is required is to pull the cap 94 outward to expose the opening in the extended tubular member and to lift and tilt the package by its handle 68, whereupon the liquid in the interior of the package can flow out through the now open spout/fitment 24A.

Figure 6:
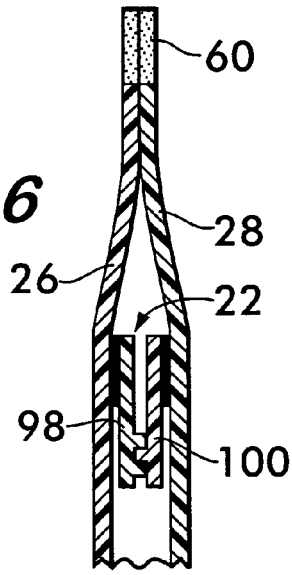
FIG. 6 is an enlarged sectional view taken along line 6—6 of FIG. 5.

As mentioned above the top edge 32 of the package is sealed along transverse seal line 60. The releasably securable closure member 22 is located on the inner surface of the first and second side panels closely adjacent the top seal 60. The closure member 22 is preferably a zipper type closure, although any type of resealably securable closure structure can be used. Thus, as can be seen in FIGS. 5 and 6, the closure 22 comprises a pair of engageable zipper-type strips 98 and 100 which are arranged to be releasably secured to each other when they are brought into engagement. The strip 98 extends across and is fixedly secured to the inner surface of the first side panel 28, while the strip 100 extends across and is fixedly secured to the inner surface of the second side panel, although the strips can be reversed. In any case, the two strips 98 and 100 extend the width of the package 20 at which they are located and terminate at the front and rear sealed edges of the package.

The package is arranged to be filled and sealed under vacuum so that the seals making up the periphery of the package maintain the vacuum within the package until it is to be opened. To effect the initial opening of the package a pair of notches 102 (FIGS. 1 and 5) are provided. One notch 102 is located in the front edge seal 58, while the other notch 102 is located in the rear edge seal 64 opposite the notch in the front edge seal. To open the package 20 the user merely tears the package across its top starting either notch 102. If desired the notches may be eliminated and other means, e.g., a weakened tear line, etc., provided to enable the package to be opened immediately below the top seal line and above the zipper closure 22. In fact, if desired, no means need be provided to enable the package to be torn open thereat. Instead the user of the package could use a scissors or other cutting implement to sever the top portion of the package above the zipper closure.

Once the package has been opened its solid or semi-solid contents can readily be removed therefrom, by merely pulling apart the two components 98 and 100 making up the zipper closure 22. This provides access to the interior of the package. If any contents are left in the package, it can readily be resealed by merely pressing the zipper closure members 98 and 100 together to releasably secure them to each other and thereby impede the ingress of air into the package's interior.

Figure 2:
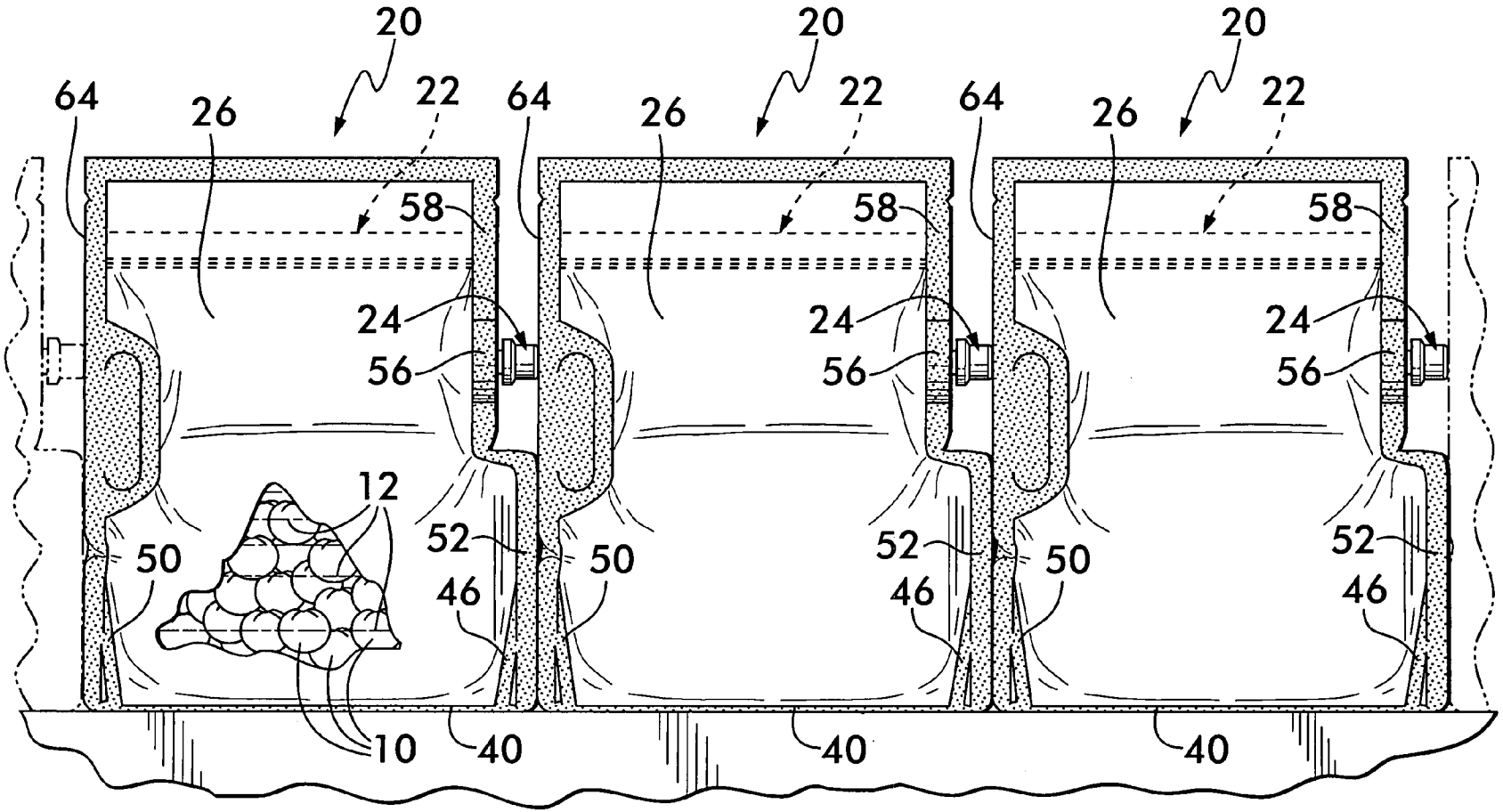
FIG. 2 is a reduced side elevation view of plural filled packages like that of FIG. 1 shown in a compact array for storage or transportation.

As best seen in FIGS. 2 and 3, when the package 20 is filled, the side panels 26 and 28 move outward, and the gusset bottom panel 30 flattens out to form a generally parallelopiped shaped structure with the gusset forming a base for supporting the package on any surface. Moreover, when the package is filled, the angled rear edge seal line 64 moves from its angled orientation (when the package is unfilled) to a generally vertical orientation. In a similar manner, the angled portion 56 of the front seal line of the package also assumes a generally vertical orientation when the package is filled, with the spout/fitment 24/24A being recessed inward from the front wall of the package.

The angled nature of the rear seal line and the recessed spout/fitment enables the package when filled to result in a vertically oriented rear wall and a vertically oriented front wall having a recessed, spout-holding section. Thus, plural filled packages of this invention may be disposed adjacent each other in a tightly packed array, like shown in FIGS. 2 and 4, without significant wasted space therebetween.

Without further elaboration the foregoing will so fully illustrate my invention that others may, by applying current or future knowledge, adopt the same for use under various conditions of service.

I claim:

1. A package having a releasably securable closure and a fitment pour spout, said package being formed of a flexible material and comprising a first side panel, a second side panel, and a bottom gusseted panel connected to one another to form a hollow interior, said first and second side panels each having an inner surface, a front edge, a rear edge, a top edge, a bottom edge and a longitudinal axis, said top and bottom edges extending generally parallel to each other and transversely to said longitudinal axis, said bottom gusseted panel being connected to said bottom edge of said first side panel to the bottom edge of said second side panel, said front edge of said first and second side panels being connected together along a front seal line, said rear edge of said first and second side panels being connected together along a rear seal line, said rear edge including a portion extending at an acute angle to said longitudinal axis, said front edge including fitment receiving portion extending at an acute angle to said longitudinal axis, said fitment being fixedly secured to said fitment receiving portion of said front edge and in communication with said hollow interior of said package, said top edge of said first and second panels being of a shorter length than said bottom edge of said first and second panels, said first and second side panel being disposed confronting each other adjacent said top edge to form an openable mouth for said package, said releasably securable closure comprising a pair of engageable components arranged to engage each other to close said mouth of said package, one of said engageable components extending along said inner surface of said first side panel adjacent said top edge of said first side panel, the other of said engageable components extending along said inner surface of said second side panel adjacent said top edge of said second side panel, said hollow interior of said package being arranged to be filled with a flowable material, whereupon said bottom gusseted panel assumes a generally planar configuration to form a horizontally disposed base for supporting the package on a surface and said rear edge of said first and second side panels extends generally perpendicularly to said base, whereupon said filled package can be located immediately adjacent similar filled packages without wasted space therebetween.

2. The package of claim 1 wherein when said package is filled said front edge of said first and second side panels extends generally perpendicularly to said base with said fitment being recessed.

3. The package of claim 1 wherein said fitment pour spout is reclosable.

4. The package of claim 3 wherein said fitment pour spout includes a threaded cap to seal it.

5. The package of claim 3 wherein said fitment pour spout is a push-pull type spout.

6. The package of claim 1 wherein said releasably securable closure is a zipper type closure.

7. The package of claim 1 additionally comprising a handle.

8. The package of claim 7 wherein said handle is located immediately adjacent said rear edge of said package.

9. The package of claim 8 wherein said first and second side panels are sealed together in an extended seal area located immediately adjacent said rear edge, and wherein said handle comprises an opening extending through a portion of said extended seal area.

10. The package of claim 9 wherein said handle comprises a generally C-shaped cut in said extended seal area, said C-shaped cut a major axis disposed generally parallel to said rear edge.

11. The package of claim 8 wherein when said package is filled said front edge of said first and second side panels extends generally perpendicularly to said base with said fitment being recessed.

12. The package of claim 8 wherein said fitment pour spout is reclosable.

13. The package of claim 12 wherein said fitment pour spout includes a threaded cap to seal it.

14. The package of claim 12 wherein said fitment pour spout is a push-pull type spout.

15. The package of claim 8 wherein said releasably securable closure is a zipper type closure.

* * * * *

UNITED STATES PATENT AND TRADEMARK OFFICE

CERTIFICATE OF CORRECTION

PATENT NO. : 7,055,720 B1
APPLICATION NO. : 10/993086
DATED : June 6, 2006
INVENTOR(S) : Barry Pritchard It is certified that error appears in the above-identified patent and that said Letters Patent is hereby corrected as shown below:

Column 1, Line 32, delete "U.S. Pat. No. 5,147,272 (Richison et al.),"

Signed and Sealed this

Seventh Day of November, 2006

JON W. DUDAS
*Director of the United States Patent and Trademark Office*